United States Patent [19]

Takahashi

[11] Patent Number: 4,542,896

[45] Date of Patent: Sep. 24, 1985

[54] SHEET CONVEYING DEVICE

[75] Inventor: Yuji Takahashi, Nakamachi, Japan

[73] Assignee: Canon Kabushiki Kaisha, Tokyo, Japan

[21] Appl. No.: 395,745

[22] Filed: Jul. 6, 1982

[30] Foreign Application Priority Data

Jul. 13, 1981 [JP] Japan ..... 56-109086

[51] Int. Cl.[4] ..... B65H 7/08

[52] U.S. Cl. ..... 271/111; 271/263; 271/265

[58] Field of Search ..... 271/263, 265, 110, 111

[56] References Cited

U.S. PATENT DOCUMENTS

| | | | |
|---|---|---|---|
| 3,809,475 | 5/1974 | Post | 271/265 X |
| 3,936,041 | 2/1976 | Shiina | 271/265 X |
| 4,078,791 | 3/1978 | Church | 271/265 X |
| 4,121,820 | 10/1978 | Forster | 271/263 X |
| 4,310,153 | 1/1982 | Hikuchi | 271/111 X |

*Primary Examiner*—Richard A. Schacher

*Attorney, Agent, or Firm*—Fitzpatrick, Cella, Harper & Scinto

[57] ABSTRACT

A sheet conveying device capable of reducing a work load on a machine operator, the device being constructed with a recording device for recording information on a sheet material conveyed on and along a conveying path; a sheet storage device for storing a stack of sheets; a sheet forwarding device for conveying the sheet material from the sheet storage device on and along the conveying path; and a control device which determines whether the sheet forwarding device is in a sheet forwarding state, or not, when the sheet conveyance is stopped, and which drives the sheet forwarding device in advance of resuming the information recording by the recording device, when the control device determines that the sheet forwarding device is in the sheet forwarding state.

8 Claims, 9 Drawing Figures

SHEET CONVEYING DEVICE

BACKGROUND OF THE INVENTION

1. Field of the Invention

This invention relates to a device for conveying sheet material such as paper. More particularly, it is concerned with a sheet conveying device capable of effectively resuming conveyance of the sheet after operation has been stopped.

2. Description of Prior Arts

In recent years, reproduction apparatus and laser beam printers have become operated at higher and higher speeds, some of which are operable at as high a printing speed as 100 sheets per minute of A4-size paper.

In general, as the running speed of the reproduction machine increases, they become large in size with the consequent elongation of the distance between a paper feeding section and a receptacle for the print-out. As a result, there tends to occur the possibility that a number of sheets of paper remain in the apparatus when paper jamming takes place within the machine causing the conveyance of the sheets to stop. Also, when a door of the apparatus main body provided with a door-switch is opened during the machine operations, the sheet conveyance is also stopped for the sake of safety. On account of this, a number of sheets remain in the sheet conveying path of the reproduction apparatus as is the case with paper jamming.

When paper jamming takes place, an operator of the device is required to remove the paper from the jammed portion in the device, while keeping the minimum removal of paper from the conveying path other than the jammed portion, so that the machine operations may be resumed in the shortest possible length of time. The reason for this is that, even if the number of sheets output per unit time is large, when much time is taken for resuming machine operations, the high speed operating performance of the printing apparatus cannot be fully taken advantage of, whereby the through-put (processing capability) of the apparatus lowers. In general, the reproduction apparatus provides in it a high temperature section surrounding an image fixing device, or a section where the toner is transferred onto the printing sheet and is required to be conveyed to the image fixing device in a non-fixed state. Since the high temperature section and toner transfer section are liable to cause burning of fingers and palm, and staining of clothes on the part of a machine operator when he (or she) is going to remove the paper during stoppage of the apparatus, it is necessary to dispense with the need for the operator to remove the paper from the portion other than the jammed spot.

On the other hand, when the door switch is actuated, the conveying device usually stops instantaneously, on account of which interruption is brought about in the conveying operation which has been established in a certain definite sequence at the paper feeding section or resist-roller section in the conveying path. As a consequence of this, there is no warranty of continued sheet conveyance even when the door switch is immediately de-actuated, but there would rather be induced paper jamming. In order to avoid such situation, it has heretofore been required of the operator to remove paper from the conveying path, imposing on him additional work.

SUMMARY OF THE INVENTION

It is therefore an object of the present invention to provide a sheet conveying device capable of reducing the amount of additional work imposed on an operator when the sheet conveying operation stops.

It is another object of the present invention to provide a sheet conveying device capable of discharging sheets by simply closing the door of the reproduction apparatus, even when the machine door should be opened during the printing operation.

It is another object of the present invention to provide a sheet conveying device capable of readily and simply discharging a sheet from the reproduction apparatus when it is jammed in the conveying path thereof.

DESCRIPTION OF PREFERRED EMBODIMENT

In the following, the sheet conveying device according to the present invention will be described in detail with reference to preferred embodiments thereof shown in the accompanying drawings.

In general, the principal timing controls required for feeding sheets of paper, etc. cut in a predetermined size are the paper feeding control and resist control at the time of paper feeding, or the timing control for a diverging device when the sheets are to be divided into at least two directions. These controls will now be explained hereinbelow in reference to FIG. 1.

Figure 1:
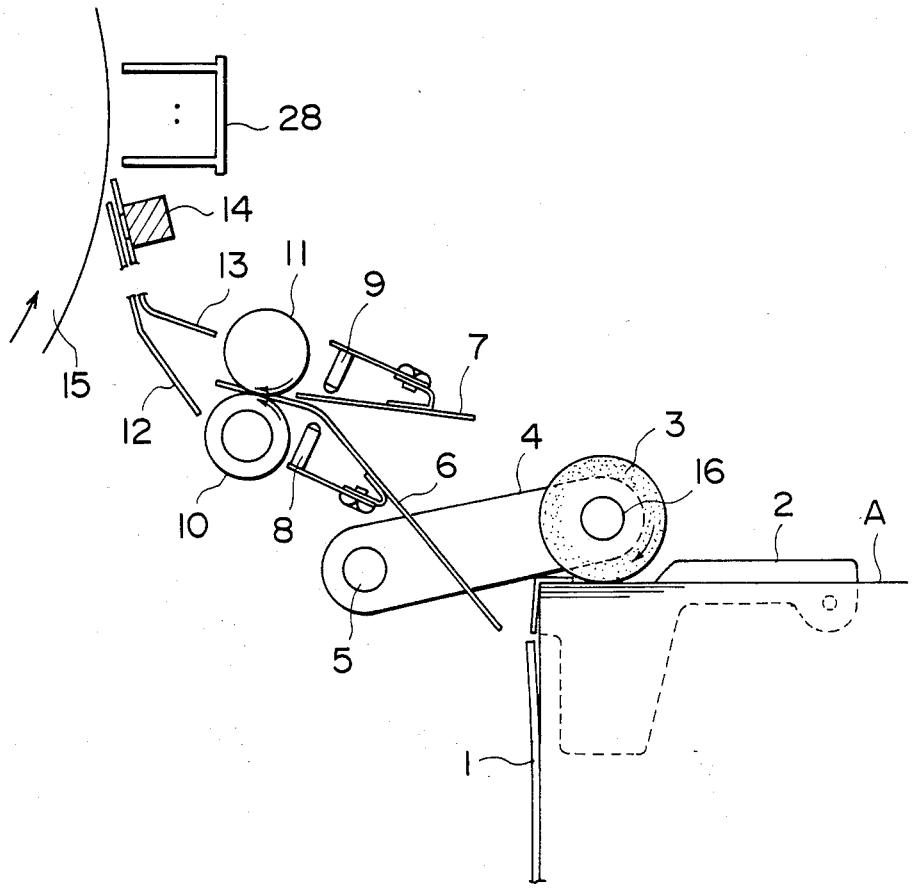
FIG. 1 is a schematic cross-section of a paper feeding section in a reproduction apparatus.

FIG. 1 illustrates an outline construction of the paper feeding and conveying mechanisms in the laser beam printer, and so forth. In the drawing, cut sheets A are stacked on a paper feeding deck 1, the top sheet being pressed downward at its forward and part by a separating pawl 2. Also, paper feeding rollers 3 held on a shaft 16 also contact the surface of the top sheet A of the stack in a freely oscillatable manner through an arm 4 which holds on its one end the shaft 16, and is, in turn, pivotally held at its other end on a pin 5. When the paper feeding rollers 3 rotate in the direction shown in the drawing, the top sheet separates from the stack A and is forwarded through paper feeding guides 6, 7 to a register roller 10 and a pressing roller 11. A light receiving sensor (i.e. photo sensor) 8 and a light emitting lamp 9 are disposed on the paper feeding guides 6 and 7 respectively to inspect presence or absence of paper as conveyed through a light passage hole formed in the paper feeding guides. The cut sheet with its forward end being positioned by the register roller 10 is further conveyed to sheet guides 12, 13, in the course of which delay in the conveyance (i.e. jamming) is checked by a reflection type sensor 14 provided on the guide member 13. After the checking, the sheet is further conveyed, while receiving on it a toner image formed on the photosensitive drum 15 by means of an image transfer charger 28.

On the upstream side of this photosensitive drum 15, there are provided, as in any ordinary electrophotographic reproduction apparatus, a primary charger to uniformly charge the photosensitive drum 15, an exposure member to irradiate light modulated by recording informations on the photosensitive drum to thereby discharge the electric charge, and a developer to develop a latent image formed on the drum by the exposure and to render the same a toner image.

In the case of the laser beam printer, the exposure member is constructed with a laser oscillator to oscillate a laser beam modulated by recording informations, and a deflector to deflect the laser beam and to irradiate the same on the photosensitive drum.

Figure 2:
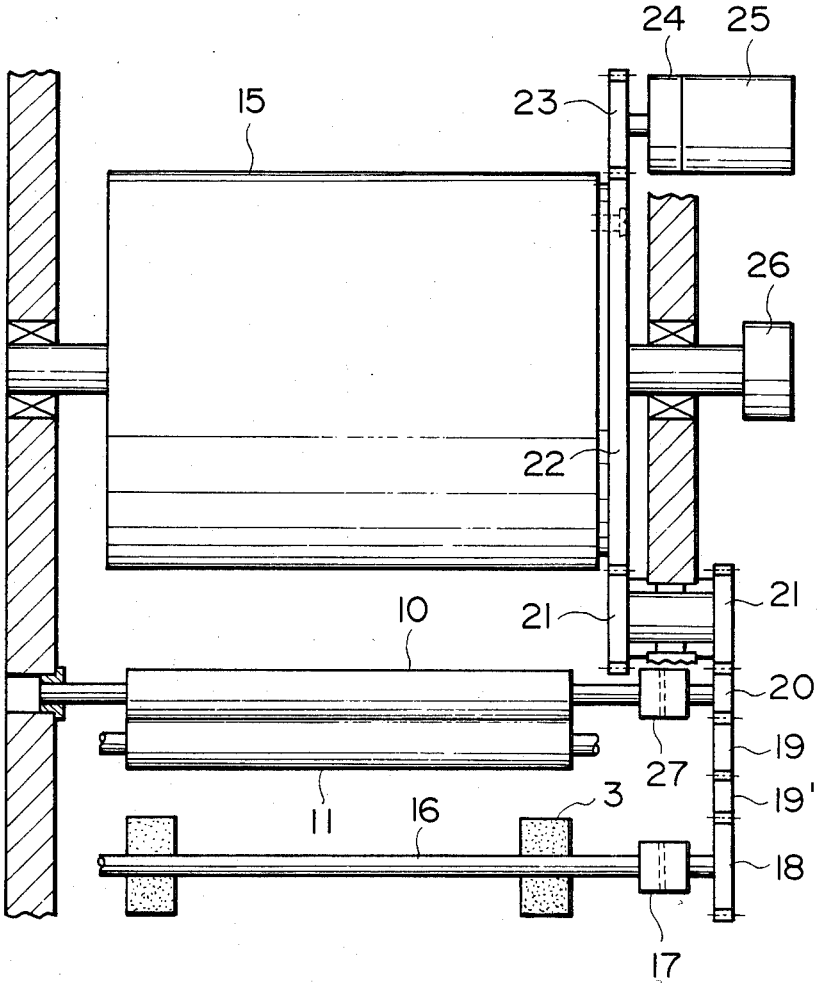
FIG. 2 is a top plan view showing a relationship among driving gears, for the paper conveyance.

FIG. 2 is a top plan view of the paper feeding and conveying mechanism. A speed reducing device 24 is mounted on a driving motor 25, rotation of which is transmitted to a drum gear 22 through a drive gear 23. The photosensitive drum 15 has a photo-encoder 26 which rotates together with the drum rotation. With clock pulses to be output from the photoencoder, the image forming cycle is controlled at every timing. The drum gear 22 further causes a register gear 20 to rotate through an intermediate gear 21. A clutch 27 is interposed between the register gear 20 and the register roller 10 to perform the register action by on/off operations of the clutch. The rotational force is further transmitted to a paper feeding gear 18 from the register gear 20 through idler gears 19, 19'. A paper feeding roller clutch 17 is interposed between the paper feeding gear 18 and the shaft 16 to perform intermittent paper feeding by on-off operations of the clutch 17.

Figure 3:
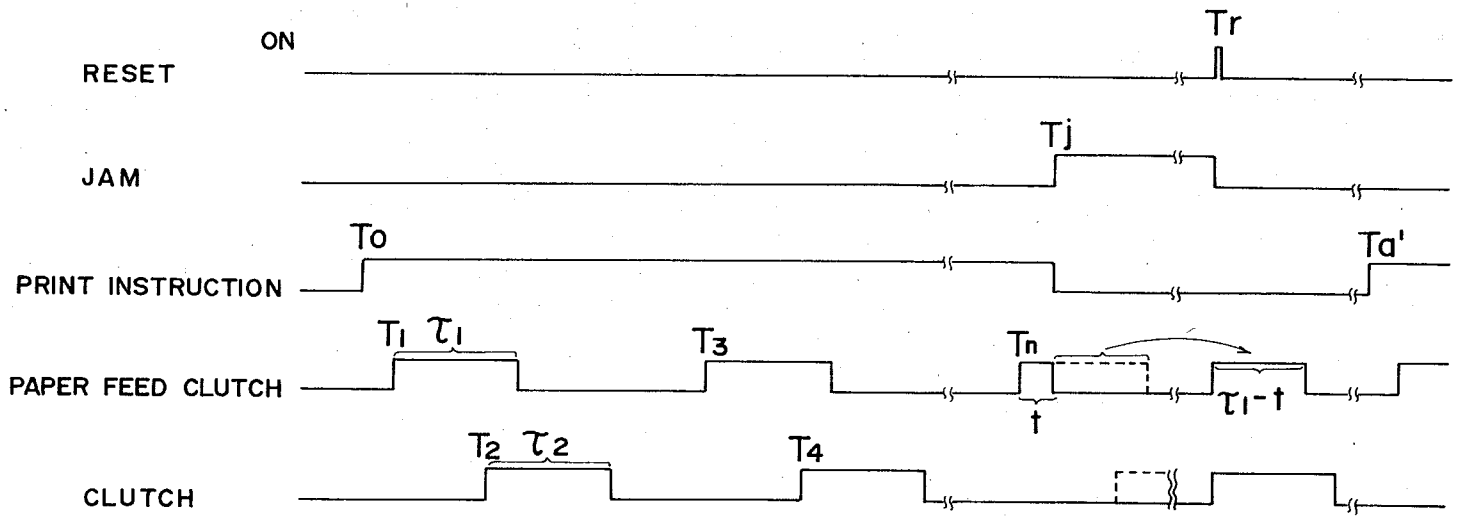
FIGS. 3 and 5 are timing charts for the sheet conveying device according to the present invention.

FIG. 3 shows a timing chart for the paper feeding operation. At a time instant $T_0$, a print instruction is entered. At $T_1$, the paper feed clutch is actuated and maintained for a time period of $\tau_1$. Subsequently, at $T_2$, the register clutch is actuated and maintained for $\tau_2$. The same operations are also effected at $T_3$ and $T_4$. Assume now that the paper feed clutch is actuated at $T_n$, and, after lapse of t, the paper jamming takes place at $T_j$. At this instant, the power to the entire drive system is turned off to stop conveyance of paper. After removal of the jammed paper, when the reset button is turned on at $T_r$, the power to the drive system is resumed, whereby those sheets of paper remaining in the conveying path, other than the jammed position, are discharged, and, at the same time, the paper which has stopped on the way of its feeding is forwarded to the register roller by actuating the paper feed clutch for an unfinished time period of $\tau_1-t$ of the preceding paper feeding operation, and is thus fed to the image transfer section. Thus, it has become possible that the paper stopped on the way of its feeding is automatically discharged without necessity for it being removed from the apparatus by the operator. Upon completion of the full feeding cycle, a fresh print instruction is given at $T_0'$, and a series of paper feeding operations are performed.

In the above-described embodiment, the place where paper jamming takes place is not the paper feeding section, but some other place in the printing apparatus. If the paper jamming occurs at the paper feed part, the paper feed clutch need not be controlled, since the jammed paper can be readily removed from the paper feed part. This situation will be explained hereinbelow in reference to the flow-chart of FIG. 4.

When paper jamming occurs, the drive system power is turned off at Step 101. Then, the place where the jam has taken place is examined at Step 102. If the place of occurrence is the paper feed part, the control operation proceeds to Step 105'. If, however, paper jamming is found, at Step 102, to have occurred at a place other than the paper feed part, the control proceeds to Step 103. At Step 103, examination is done as to whether the jam and machine stoppage has taken place during a paper feed operation, or not. If they have not occurred during the paper feed operation, the control proceeds to Step 105'. If, on the other hand, they occurred during a paper feed operation, the remaining time to finish the paper feed is calculated at Step 104 for actuating the paper feeding clutch. At Step 105, the control is in a stand-by state with a dynamic loop until the operator turns on a reset button as soon as the jammed paper is disposed of. Subsequently, at Step 106, the drive system power is supplied, whereby those sheets of paper at other places than the paper feed part are discharged from the conveying path as soon as the sheet conveying system begins to move. At step 107, the sheet which has stopped on its way is fed by energizing the paper feed clutch for a remaining time period of $(\tau_1-t)$ as calculated at Step 104, thereby enabling the sheet to be conveyed to the register roller which is already in operation. It should be noted here that the abovementioned remaining time need not be accurately $(\tau_1-t)$, but may be somewhat longer than that, i.e., $(\tau_1-t)+t_\alpha$. Step 105' is the same as Step 105 where the control is in a stand-by state until the operator turns on the reset button. Upon actuation of the reset button, the control proceeds to Step 106'. In other words, the sheet conveying system is driven by the controls at Steps 105' and 106' without actuating the paper feeding system.

Figure 5:
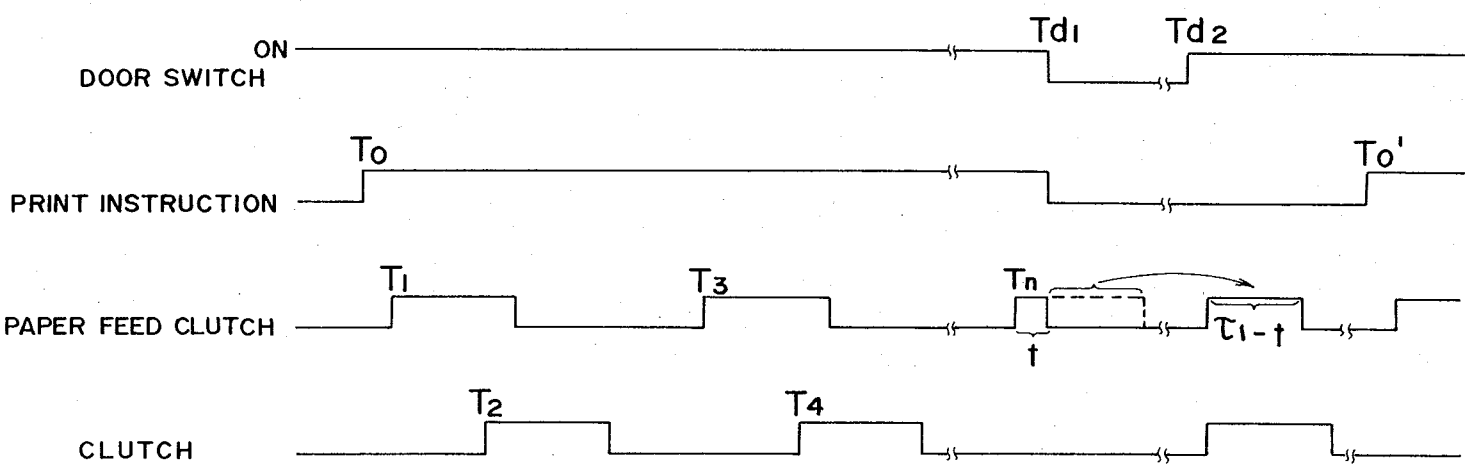

FIG. 5 shows a case, wherein the door switch becomes open during the printing operation, not the paper jamming, and the sheet conveying system stops its operation. Same as in FIG. 3, the paper feed clutch is actuated at $T_n$, and, after lapse of a time period t, the door switch is opened at $Td_1$, whereupon the entire driving system power is turned off to stop conveyance of the sheet. When the door switch is closed at $Td_2$ upon closure of the door by the operator, the paper feed clutch is actuated for an unfinished time $(\tau_1-t)$ of the preceding paper feeding operation, and, at the same time, the power is supplied to the driving system to effect the sheet conveyance. In this case, the time delay $\tau$ remains until the paper feed clutch is actuated. The reason for this is that, since the image fixing device (not shown in the drawing) is deactuated by opening of the door and the temperature of the image fixing device lowers accordingly, the time delay $\tau$ (which changes in correspondence to the de-actuation period of the image fixing device) remains until the image fixing device attains a temperature level, at which the image fixing becomes possible, even when electric conduction to the image fixing device is started by closure of the door. By thus closing the door to actuate the paper feed clutch for a time period of $\tau_1-t$, it has become possible to automatically discharge the sheet without necessity for the operator to remove the sheets retained on its way of feeding. Then, again, the print instruction is issued, and a series of paper feeding operations are carried out.

Figure 6:
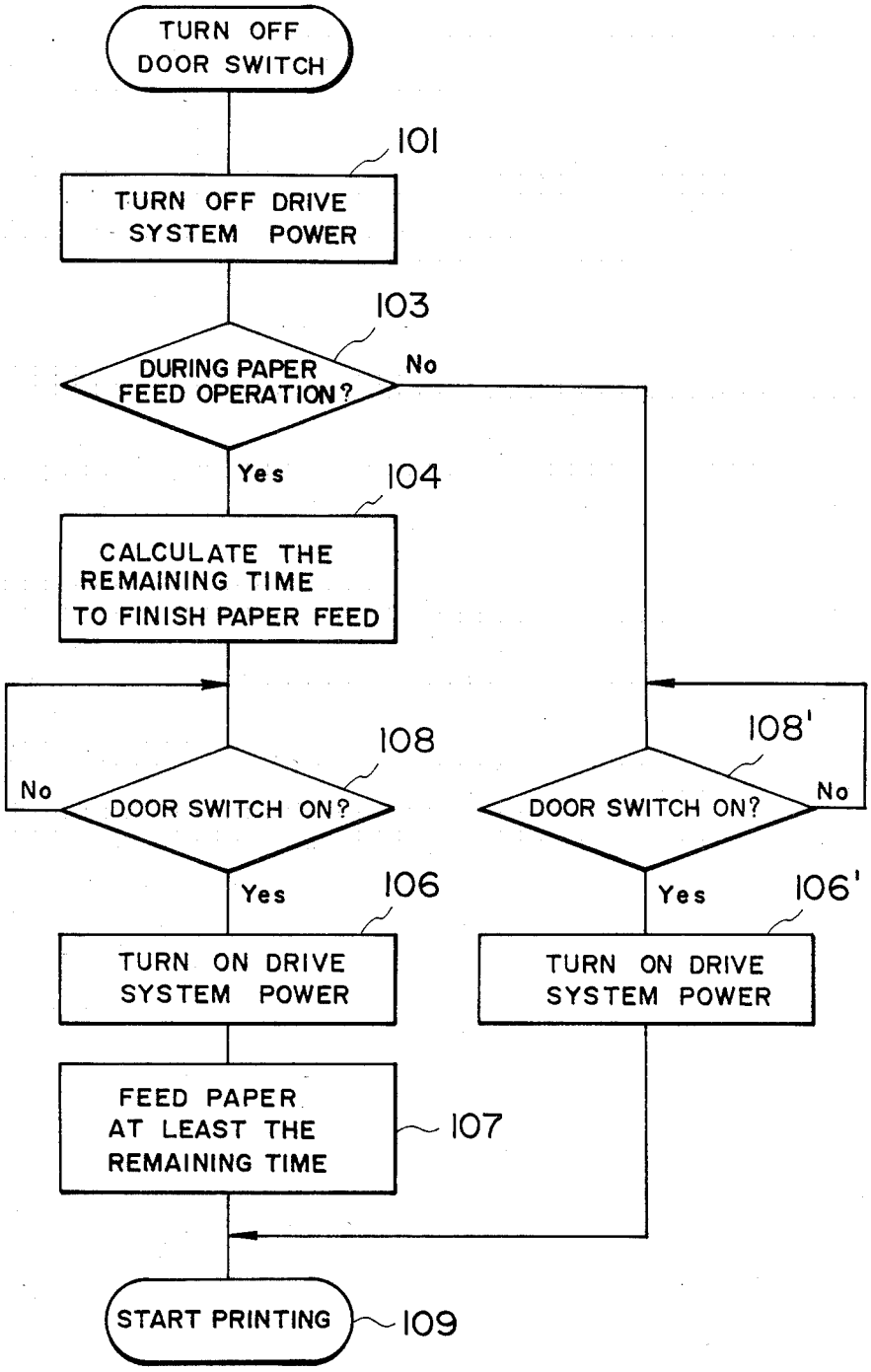

Reference will now be had to the flow chart of FIG. 6 for explaining the control operations when the door switch is turned off by opening of the door and the apparatus stops its operation.

When the door of the device opens to turn the door switch off, the drive system power is interrupted at Step 101, followed by examination at Step 103 as to whether the stoppage occurred during the paper feeding operations, or not. If the stoppage does not occur during the paper feeding operations, the control proceeds to Step 108' where the drive system remains in "power-off" state until the door switch is turned on. As soon as the door switch is on, the drive system is powered on. On the contrary, if it is determined at Step 103 that the stoppage occurred during the paper feeding operation, the time delay $\tau_1 - t$ in FIG. 5 is computed. When it is judged at Step 108 that the door switch is turned on, the drive system is powered on at Step 106, and, at the same time, the paper feeding is effected at Step 107 (by actuating the paper feeding roller clutch 17) for at least an unfinished time period for paper feeding (i.e., at least $\tau_1 - t$).

Figure 4:
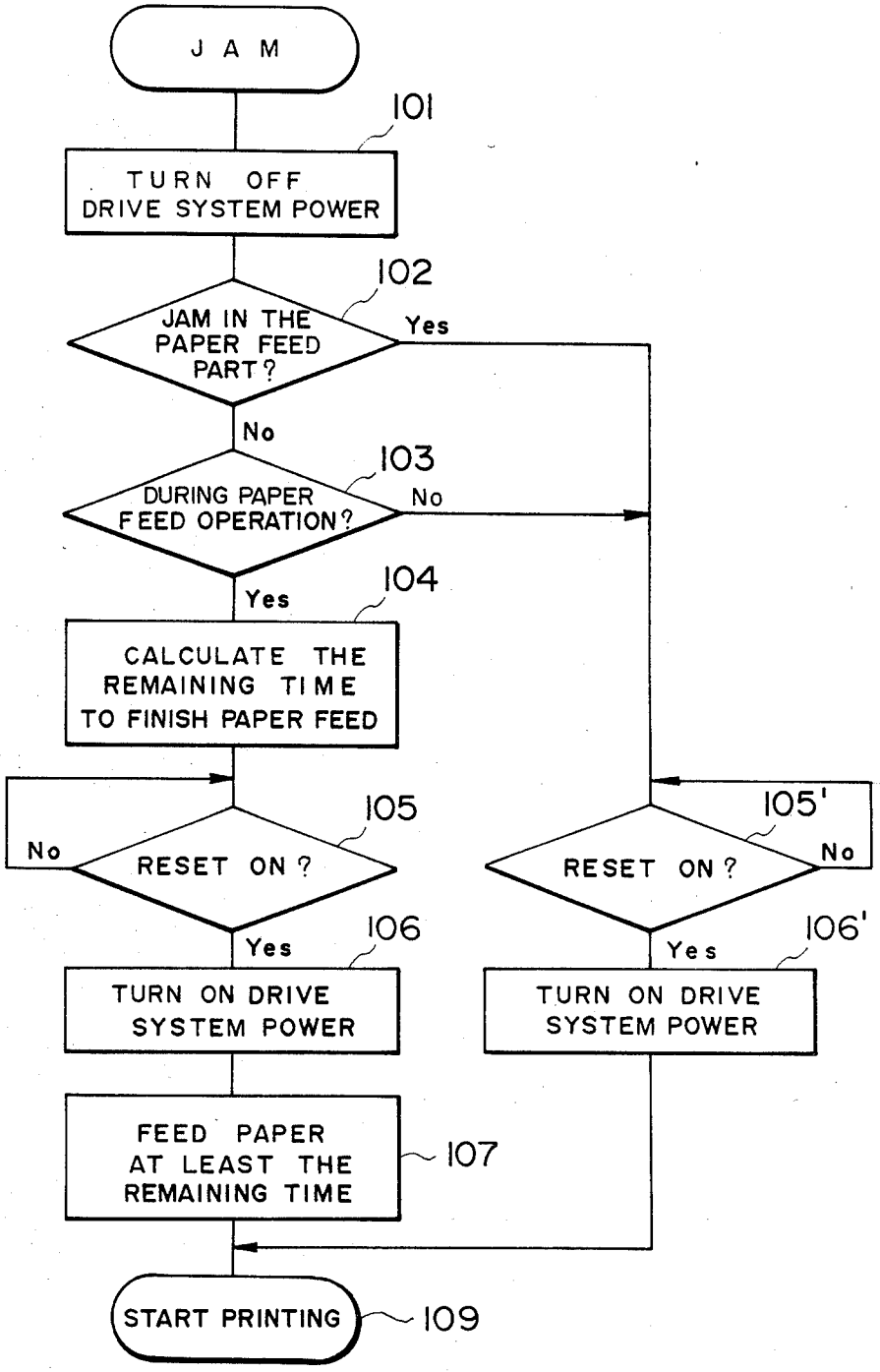
FIGS. 4, 6 and 9 are control flow charts of the sheet conveying device according to the present invention.
Figure 7:
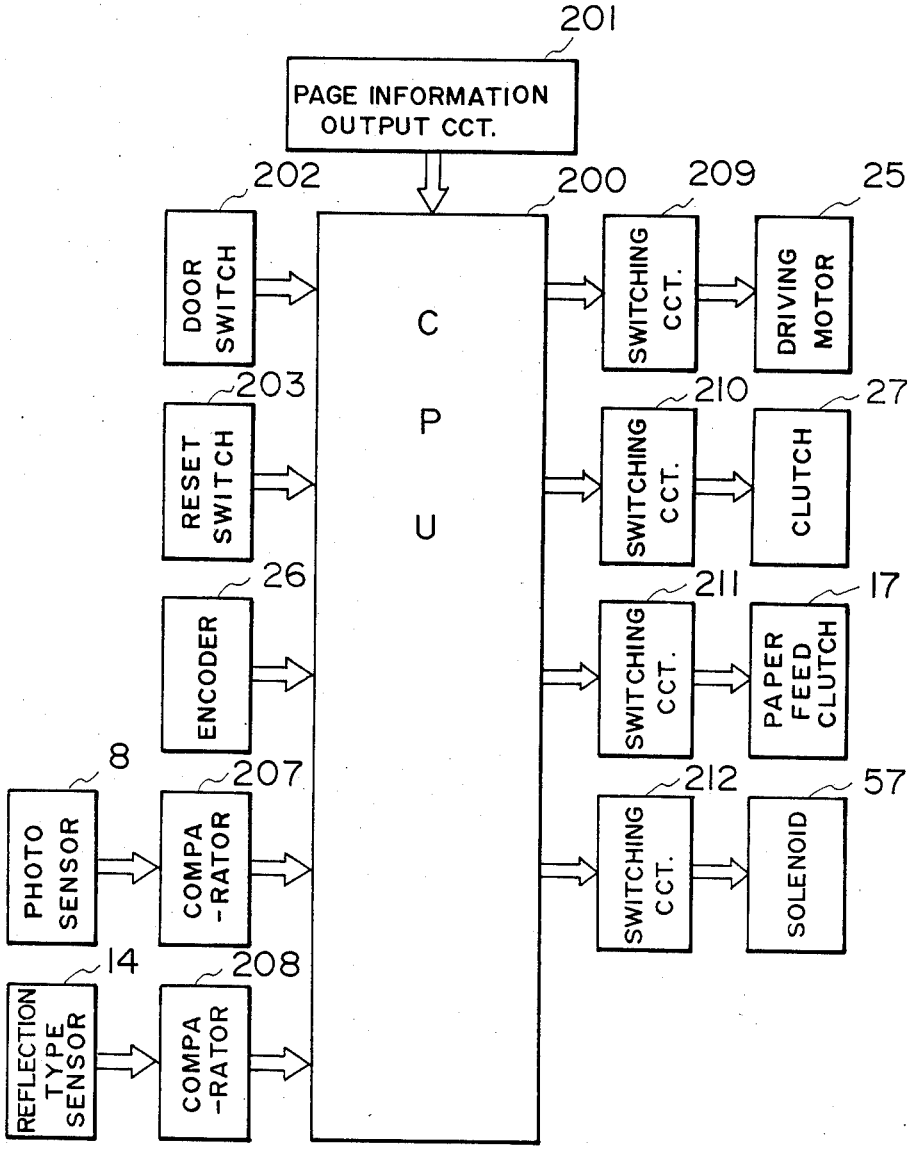
FIG. 7 is a block diagram showing a control circuit for the sheet conveying device of the present invention.
Figure 9:
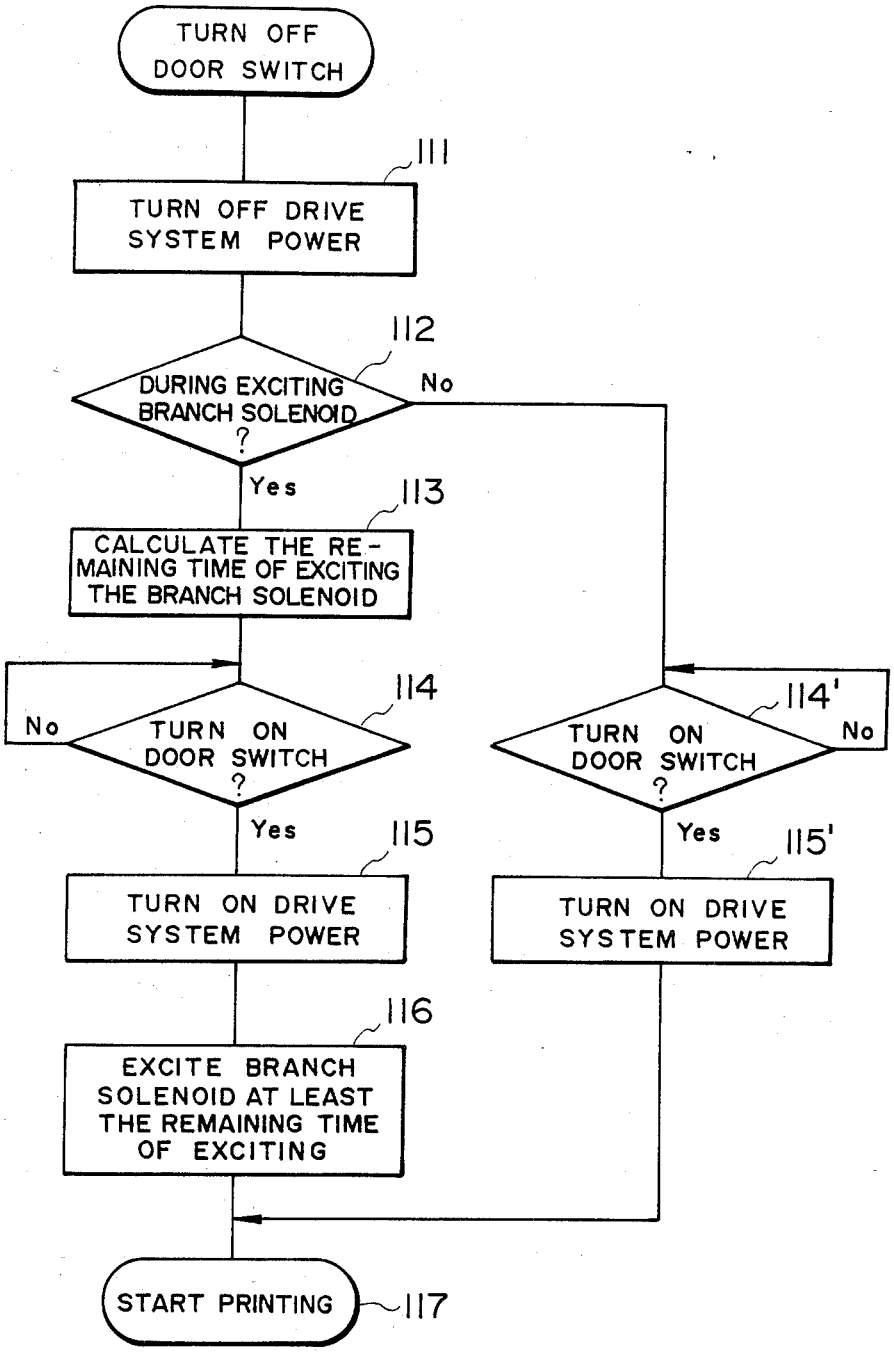

FIG. 7 illustrates an outline of the control system, wherein a reference numeral 200 designates a central processing unit (CPU) to perform operations and controls of the recording apparatus in accordance with programs stored in ROM (not shown) as shown in FIGS. 4, 6 and 9; a numeral 8 refers to a photo sensor; and 14 a reflection-type sensor. Signals from these sensors are compared with a reference value by comparators 207, 208, and introduced into the CPU 200 as inputs to be used for jam detection. It is, of course, possible that the jam detection be carried out at various places on the conveying path by providing paper sensors therealong. A numeral 202 refers to a door switch which is turned off by opening of a door (not shown) of the recording apparatus; a reference numeral 203 designates a reset switch; and 26 an encoder to introduce the recording informations directly into the CPU as input digital signals. A reference numeral 201 represents a page information output circuit, through which a print start instruction is input into the CPU. On the other hand, control signals from the CPU 200 actuate the motor 25, the clutch 27, the paper feeding roller clutch 17, and a solenoid 57 in a preferred embodiment to be mentioned later, through the respective switching circuits 209, 210, 211, and 212.

In the foregoing, explanations have been given as to an actual embodiment of the paper feeding section. In the following, further explanations will be given as to another mode of embodiment in reference to FIG. 8.

Figure 8:
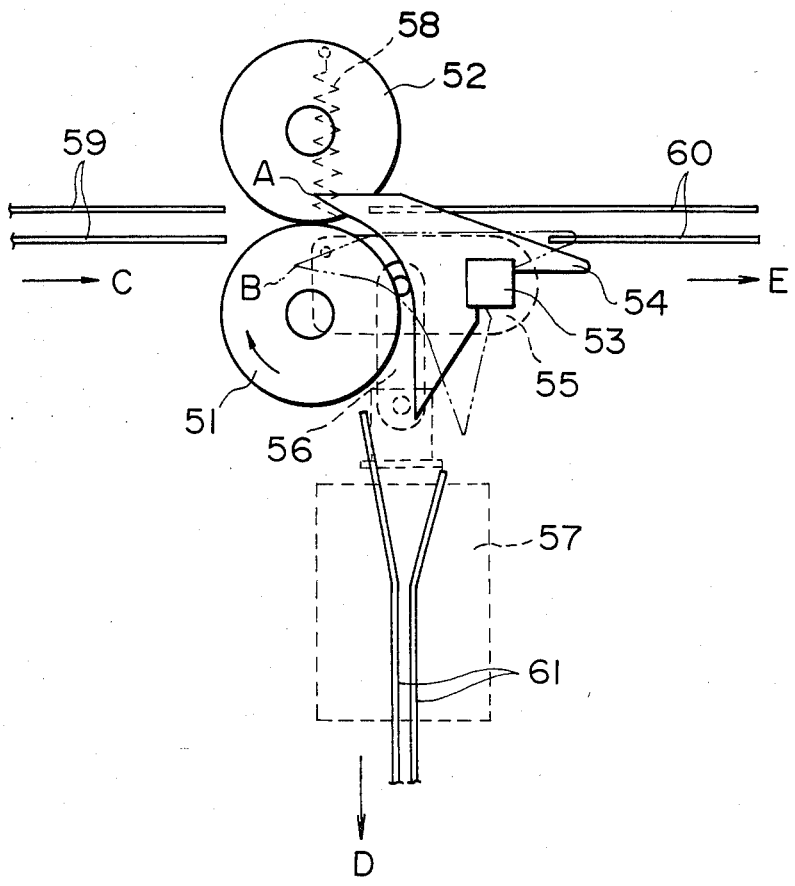
FIG. 8 is a cross-sectional view showing a change-over mechanism in the sheet conveying device.

FIG. 8 illustrates a diverging mechanism for changing a conveying direction of the sheet which has completed image recording on it by a mechanism, for example, as shown in FIG. 1. In the drawing, the driving roller 51 is rotated clockwise by a motor (not shown), and a follower roller 52 is urged onto the driving roller. An appropriate clearance is formed in the axial direction of the driving roller 51 and the follower roller 52. A deflector 54 is held on a supporting shaft 53 in such a manner that it may be in an interfering relationship with the clearance between the two rollers. An arm 55 is pivotally fitted at one end of the supporting shaft 53. A return spring 58 is extended at one end part of the arm. The center part of the arm is pin-connected with a solenoid 57 by a link 56. In a non-energized state of the solenoid 57, the deflector 54 is in a state as shown by a solid line, and its distal end is at a position A, whereby the paper which has been conveyed from the direction C passes through a guide 59, after which the sheet changes its conveying direction, passes through the guide 61, and is transported in the direction D. In an energized state of the solenoid 57, on the other hand, the deflector 54 is in a state as shown in dotted line, and its distal end is at a position B, whereby the paper which has been conveyed from the abovementioned direction C passes through a guide 60 and is conveyed in the direction E.

Now, in such sheet diverging mechanism, when the sheet is conveyed from the direction C to the direction E, if the door switch is in an "off" state, the power to the driving system is turned off, and the solenoid which has so far been in an energized state is de-energized accordingly. Subsequently, when the door switch is turned on, if the solenoid remains non-energized, the paper is caught by the deflector, even when the driving system is actuated, thereby causing paper jamming. Therefore, on the part of the solenoid, computation is also carried out for an unfinished time of electric conduction to the solenoid, when the power is supplied to the driving system, to hold the solenoid in its energized state for the portion of the time period as calculated, whereby it becomes possible to discharge the sheet out of the recording device without causing paper jamming.

FIG. 9 shows details of the control flow. The flow chart is identical in content with that shown in FIG. 6 with the exception that the object of driving is the sheet diverging solenoid. It will also be apparent that the control flow chart can be used for explanations in not only a case where the door switch is turned off, but also the paper jamming takes place.

As described in the foregoing, the sheet conveying device according to the present invention makes it possible to discharge paper remaining in the image recording device with the least intervention of an operator, even when the door switch is opened at the occurrence of the paper jamming or during the machine operation to abruptly stop the printing apparatus. In particular, the paper feeding mechanism, or the mechanism such as sheet diverging section, etc. where the operations are controlled by timing has become virtually unnecessary to have intervention of the operator by improving the sequence controls for its operations.

I claim:

1. A sheet conveying device which comprises:

(a) sheet storage means for storing a plurality of sheets;

(b) a sheet conveying path;

(c) means for forwarding a sheet from said sheet storage means onto said conveying path;

(d) recording means for recording information on the sheet conveyed on said conveying path; and (e) control means which determines whether said sheet forwarding means was in a sheet forwarding state, or not, when sheet conveyance is stopped, and which drives said sheet forwarding means in advance of resuming the information recording by said recording means, when said control means determines that said sheet forwarding means was in the sheet forwarding state.

2. A sheet conveying device as set forth in claim 1, wherein said control means detects sheet jamming, and stops conveyance of sheet.

3. A sheet conveying device as set forth in claim 1, wherein said control means detects opening of a door switch, and stops sheet conveyance.

4. A sheet conveying device as set forth in claim 1, wherein said sheet forwarding means comprises sheet feeding rollers.

5. A sheet conveying device which comprises:

(a) sheet storage means to store a plurality of sheets;
(b) a sheet conveying path;
(c) sheet conveying means to convey a sheet which has been sent out of said sheet storage means along said conveying path;
(d) sheet forwarding means to forward a sheet onto said sheet conveying path from said sheet storage means; and
(e) control means which determines whether said sheet forwarding means was in a sheet forwarding state, or not, when said conveying means is stopped, and which drives said sheet conveying means to forward a sheet which is in said forwarding state onto said conveying path at the resumption of sheet conveyance by said conveying means, when said control means determines that said sheet forwarding means was in the forwarding state.

6. A sheet conveying device as set forth in claim 5, wherein said control means determines a timing for driving said sheet forwarding means in order to forward the sheet which is in said forwarding state onto said conveying path.

7. A sheet conveying device as set forth in claim 5, wherein said sheet forwarding means comprises sheet feeding rollers, and a clutch interposed between one of said sheet feeding rollers and a driving source for said feeding rollers.

8. A sheet conveying device which comprises:
(a) a sheet conveying path;
(b) recording means to record information on a sheet conveyed on and along said conveying path;
(c) operating means which operates intermittently to control movement of the sheet; and
(d) control means which determines whether said operating means was in an operative state, or not, when said recording means stops recording, and which drives said operating means in advance of resuming the recording operation by said recording means, when said control means determines that said operating means was in an operative state.

* * * * *